US005762451A

United States Patent [19]

Stankus et al.

[11] Patent Number: 5,762,451

[45] Date of Patent: Jun. 9, 1998

[54] MULTI-PIECE, SPLIT BAIL EXPANSION ANCHOR

[75] Inventors: John C. Stankus, Canonsburg, Pa.; Song Guo, Morgantown, W. Va.; Frank Calandra, Jr., Pittsburgh, Pa.

[73] Assignee: Jennmar Corporation, Pittsburgh, Pa.

[21] Appl. No.: 806,632

[22] Filed: Feb. 26, 1997

[51] Int. Cl.[6] ..... E21D 20/00

[52] U.S. Cl. ..... 405/259.1; 411/64; 411/67

[58] Field of Search ..... 405/259.1, 259.6, 405/259.5; 411/15, 18, 32, 77, 76, 73, 72, 60, 55, 44, 64, 67, 61

[56] References Cited

U.S. PATENT DOCUMENTS

| | | | |
|---|---|---|---|
| 1,407,782 | 2/1922 | Church et al. | 411/68 |
| 2,988,950 | 6/1961 | Dempsey . | |
| 3,017,799 | 1/1962 | Lemoine . | |
| 3,115,056 | 12/1963 | Teeple, Jr. . | |
| 3,200,693 | 8/1965 | Dickow . | |
| 3,226,934 | 1/1966 | Emery . | |
| 3,250,170 | 5/1966 | Siegel . | |
| 3,306,051 | 2/1967 | Howlett . | |
| 3,311,012 | 3/1967 | Williams . | |
| 3,469,407 | 9/1969 | Kovacs . | |
| 3,683,741 | 8/1972 | Pete . | |
| 4,000,623 | 1/1977 | Meardi . | |
| 4,011,787 | 3/1977 | White et al. . | |
| 4,100,748 | 7/1978 | Hansen . | |
| 4,195,952 | 4/1980 | Swanson | 405/259 |
| 4,299,515 | 11/1981 | Yates et al. | 405/259 |
| 4,380,407 | 4/1983 | Donan, Jr. | 405/259 |
| 4,516,883 | 5/1985 | Zeitler | 405/260 |
| 4,518,292 | 5/1985 | Calandra et al. | 405/259.6 X |
| 4,753,559 | 6/1988 | Pentesco | 411/61 |
| 5,011,337 | 4/1991 | Clark et al. | 405/259.1 X |
| 5,028,188 | 7/1991 | Prince | 411/67 |
| 5,094,577 | 3/1992 | Clark et al. | 411/64 |
| 5,098,227 | 3/1992 | Wright | 405/259.6 |
| 5,275,512 | 1/1994 | Wright | 405/259.6 |
| 5,344,257 | 9/1994 | Wright et al. | 405/259.1 X |
| 5,352,066 | 10/1994 | Schaeffer et al. | 405/259.6 |

*Primary Examiner*—Dennis L. Taylor

*Attorney, Agent, or Firm*—Webb Ziesenheim Bruening Logsdon Orkin & Hanson, P.C.

[57] ABSTRACT

A mine roof bolt expansion anchor is formed from a plurality of identical shell segments. Each shell segment has a first end, a second end, and an end section at the first end. A first finger extends from the end section to the second end of the shell segment. A second finger extends from the end section toward the second end of the shell segment and terminates at a distal edge spaced from the second end of the shell segment. The end section, the first finger and the second finger each include an inner surface and an outer surface. A deformable coupling couples a plurality of shell segments together to form a multi-piece shell. The inside surfaces of the end sections, the first fingers and the second fingers of the multi-piece shell define a central aperture in which a wedge, adapted to coact with the plurality of shell segments, is received in the central aperture. Movement of the wedge from the second end to the first end of the shell segments forces the fingers to move in an outwardly direction.

20 Claims, 2 Drawing Sheets

MULTI-PIECE, SPLIT BAIL EXPANSION ANCHOR

BACKGROUND OF THE INVENTION

1. Field of the Invention

The present invention relates to bail type mine roof expansion anchors.

2. Description of the Prior Art

In underground mining operations, unsupported rock formations are reinforced by bolts that are inserted into bore holes drilled in the rock formations and secured to the rock formations by engagement of an expansion anchor on the end of the bolt with the rock formations. A bearing plate is retained on the end of the bolt that extends from the bore hole and abuts the roof. Applying a rotating torque to the bolt expands the expansion anchor to engage the wall of the bore hole which brings the bolt under tension and compresses the rock strata. Compressing the rock strata forms composite beams of the strata that resist forces that apply shear stresses to the rock formations.

Expansion anchors are widely used for supporting and reinforcing rock structures such as mine roofs. One type of expansion anchor includes a hollow shell surrounding a tapered wedge. The hollow shell has a bail typically positioned along an upper extent of the shell to prevent the shell and the wedge from becoming disassociated when the expansion anchor is utilized. In use, the shell is radially expanded into gripping contact with the wall of the bore hole formed in the rock formations by axial movement of the tapered wedge in the shell. The wedge is moved axially by rotating the bolt in threaded engagement with a central bore of the wedge.

One type of prior art expansion anchor includes a unitary expansion shell having an integral bail. Another type of expansion anchor includes a multi-piece shell held together by an attachable bail. A feature common to the unitary expansion shell and the multi-piece expansion shell is longitudinally extending expansion elements, or fingers, each finger having the same length. Another feature common to the unitary expansion shell and the multi-piece expansion shell is the bail is typically located adjacent an upper extent of the shell that is positioned adjacent the blind end of the bore hole. Still another feature of the multi-piece expansion shell is the absence of a coupling, other than the bail, to help maintain the shell segments together.

It is an object of the present invention to provide an inexpensive expansion anchor.

SUMMARY OF THE INVENTION

Accordingly, the present invention is an expansion anchor for anchoring a mine roof bolt in a bore hole. The expansion anchor includes a multi-piece expansion shell and a wedge. The multi-piece expansion shell includes a plurality of identical shell segments having a first end and a second end. Each of the shell segments includes an end section at the first end, a first finger extending from the end section to the second end of the shell segment, and a second finger extending from the end section toward the second end of the shell segment. The second finger terminates at a distal edge spaced from the second end of the shell segment. The first finger has an outer edge that extends from the end section to the second end of the shell segment. The second finger has an outer edge that extends between the end section and the distal edge of the second finger. The first finger and the second finger each include an inner surface and an outer surface. The outer surfaces of the first finger and the second finger include a plurality of serrations. A longitudinally extending opening is defined between the first finger and the second finger. Each shell segment includes a radially and inwardly extending bail positioned on the first finger adjacent the second end of the shell segment. The end section of each shell segment has a first outer edge that extends between the first end of the shell segment and the outer edge of the first finger. The end section of each shell segment also has a second outer edge that extends between the first end of the shell segment and the outer edge of the second finger. The first outer edge lies along a first line that extends parallel to a longitudinal axis passing through the shell segment. The second outer edge lies along a second line that extends parallel to the longitudinal axis passing through the shell segment. The outer edge of the first finger and the first line define a first angle therebetween. Similarly, the outer edge of the second finger and the second line define a second angle therebetween. Preferably, the first angle and the second angle are the same. Each shell segment further includes a projection extending from one of the first outer edge and the second outer edge of the end section and a slot formed in the other of the first outer edge and the second outer edge of the end section.

A deformable retainer, such as a ring formed of wire, plastic or rubber, is utilized to secure the plurality of segments together to form the multi-piece shell. In the multi-piece shell, the outer edge of the first finger of one of the shell segments is positioned adjacent the outer edge of the second finger of an adjacent one of the shell segments and an opening is defined therebetween. The openings between the outer edges of the fingers of adjacent shell segments diverge from the end sections to the distal edges of the second fingers. The projection extending from one of the edges of the end sections of the one of the shell segments is received in the slot formed in one of the outer edges of the end section of the adjacent one of the shell segments. The inner surfaces of the end sections, the first fingers and the second fingers define a central aperture in the multi-piece shell. The wedge is received in the central aperture. The bails of the expansion anchor form a stop for preventing the wedge from further movement in the central aperture.

The wedge has a wedge body with a threaded central aperture therein. The wedge also has a plurality of wedging surfaces adapted to contact and coact with the first fingers and the second fingers.

The expansion anchor is received on the threaded end of a mine roof bolt. More specifically, the threaded end of the mine roof bolt is positioned within the central aperture of the multi-piece shell. The threaded central aperture of the wedge is threadedly received by the threaded end of the mine roof bolt.

The mine roof bolt and expansion anchor are positioned in the bore hole with the expansion anchor positioned adjacent a blind end of the bore hole. A headed end of the mine roof bolt extends from an open end of the bore hole and engages a bearing plate positioned between the headed end of the mine roof bolt and the rock surrounding the bore hole. Applying a rotating torque to the head of the mine roof bolt causes the wedge to move towards the headed end of the bolt. This movement of the wedge forces the first fingers and the second fingers to move in an outward direction and engage the wall of the bore hole.

DETAILED DESCRIPTION OF THE PREFERRED EMBODIMENT

Figure 1:
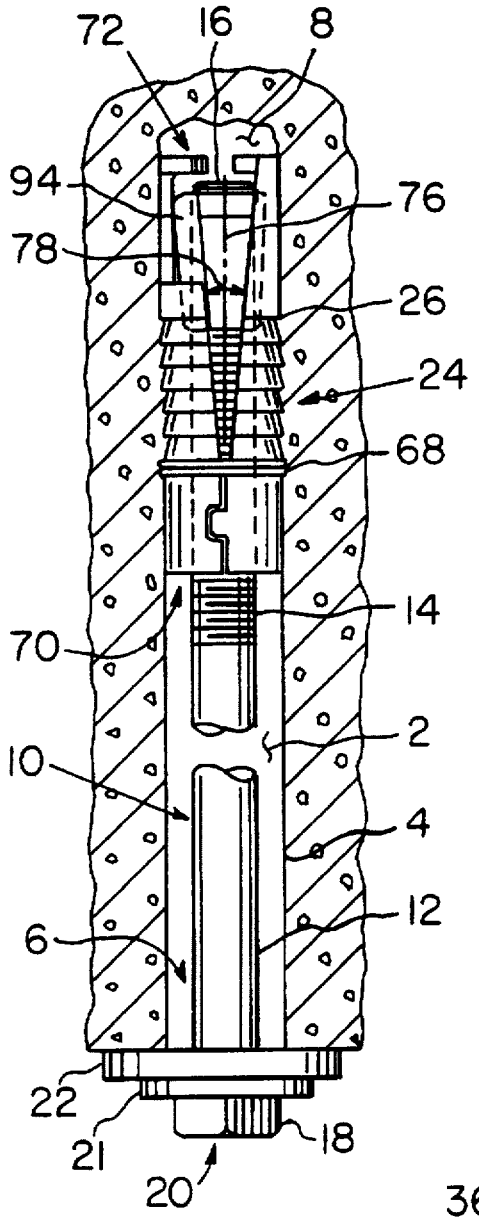
FIG. 1 is an elevational view of an expansion anchor in accordance with the present invention installed on a threaded end of a mine roof bolt, positioned in a bore hole and showing the expansion anchor in an unengaged state.

With reference to FIG. 1, a bore hole 2 formed in a rock formation is defined by a bore hole wall 4 and has an open end 6 and a closed or blind end 8 at opposite ends of the bore hole 2. Installed in the bore hole 2 is a mine roof bolt 10 that has a bolt shaft 12 that extends along a longitudinal axis. The bolt 10 has threads 14 defined at a threaded end 16 positioned in the blind end 8 of the bore hole 2 and a head 18 defined at a headed end 20 opposite the threaded end 16 and extendable from the open end 6 of the bore hole 2. A bearing plate 22 is retained on the bolt shaft 12 by a flange 21 and the head 18 at the headed end 20 of the mine roof bolt 10. Attached to the threaded end 16 of the mine roof bolt 10 is an expansion anchor 24.

Figure 2:
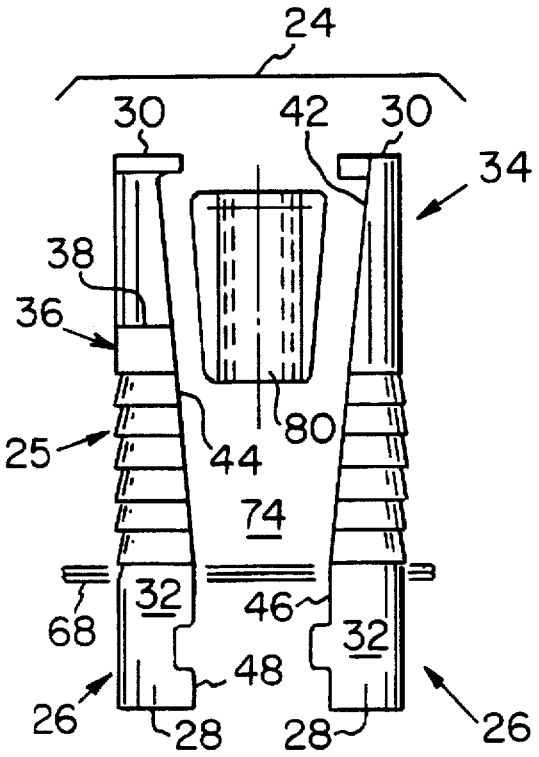
FIG. 2 is an exploded view of the expansion anchor of FIG. 1 showing a wedge of the expansion anchor positioned between opposing shell segments of the expansion anchor.
Figure 3:
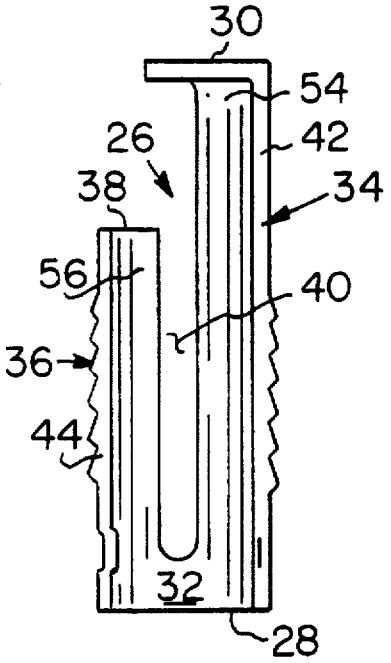
FIG. 3 is an elevational rear view of one of the shell segments of FIG. 2.

With reference to FIGS. 2 and 3, the expansion anchor 24 includes a multi-piece shell 25 formed from a plurality of identical shell segments 26 having a first end 28, a second end 30 and an arcuate end section 32 positioned adjacent the first end 28 of the shell segment 26. A first finger 34 extends between the end section 32 and the second end 30 of the shell segment 26 and a second finger 36 extends from the end section 32 toward the second end 30 and terminates at a distal edge 38 spaced from the second end 30 of the shell segment 26. The first finger 34 and the second finger 36 define a lengthwise opening or slit 40 therebetween. The first finger 34 has an outer edge 42 that extends between the end section 32 and the second end 30. The second finger 36 has an outer edge 44 that extends between the end section 32 and the distal edge 38. The outer edge 42 of the first finger 34 and the outer edge 44 of the second finger 36 preferably diverge from the end section 32 to the second end 30 of the shell segment 26.

Figure 4:
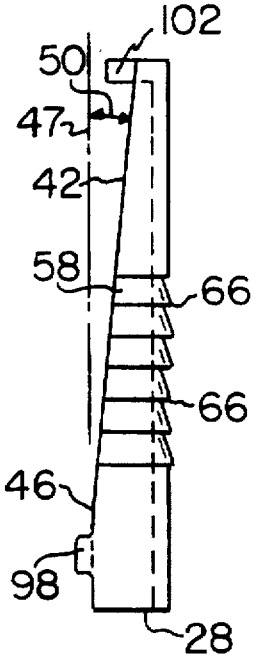
FIG. 4 is an elevational right side view of the shell segment shown in FIG. 3.
Figure 5:
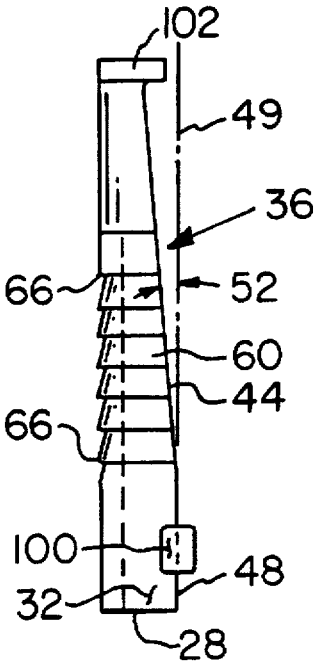
FIG. 5 is an elevational left side view of the shell segment shown in FIG. 3.
Figure 6:
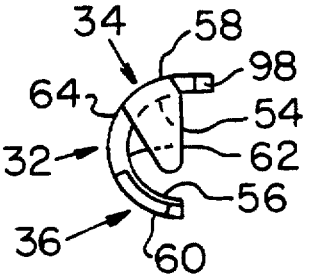
FIG. 6 is a top end view of the shell segment shown in FIG. 3.

With reference to FIGS. 4–6 and with continuing reference to FIGS. 2 and 3, the end section 32 of each shell segment 26 has a first outer edge 46 and a second outer edge 48 on opposite sides of the shell segment 26. The first outer edge 46 and the second outer edge 48 are shown partially in phantom in FIGS. 4 and 5. The first outer edge 46 of the end section 32 extends from the outer edge 42 of the first finger 34 toward the first end 28 of the shell segment 26. Similarly, the second outer edge 48 of the end section 32 extends from the outer edge 44 of the second finger 36 toward the first end 28 of the shell segment 26. The first outer edge 46 lies along a first line 47 that extends parallel to a longitudinal axis passing through the shell segment 26. Similarly, the second outer edge 48 lies along a second line 49 that extends parallel to the longitudinal axis passing through the shell segment 26. The outer edge 42 of the first finger 34 and the first line 47 define a first angle 50 therebetween. Similarly, the outer edge 44 of the second finger 36 and the second line 49 define a second angle 52 therebetween. Preferably, the first angle 50 and the second angle 52 are the same angle.

The first finger 34 and the second finger 36 of each shell segment 26 has inside or inner surfaces 54 and 56 and outside or outer surfaces 58 and 60, respectively. Similarly, the end section 32 has an arcuate shaped inside surface 62 and an arcuate shaped outside surface 64. The inner surface 54 of the first finger 34 and the inner surface 56 of the second finger 36 preferably transition from an arcuate shape adjacent end section 32 to flat adjacent the distal edge 38. The outside surface 58 of the first finger 34 and the outside surface 60 of the second finger 36 have a plurality of serrations 66 between the end section 32 and the distal edge 38 of the second finger 36. The serrations 66 are preferably longitudinally spaced and circumferential.

The end section 32 of each shell segment 26 preferably includes a projection 98 extending from the first outer edge 46 and a slot 100 formed in the second outer edge 48. Moreover, each shell segment 26 also includes a radially and inwardly extending bail 102 positioned on the first finger 34 adjacent the second end 30 of the shell segment 26.

Referring to FIGS. 1 and 2, a deformable coupling 68, such as, for example, a ring formed of wire, plastic or rubber, secures a plurality of the shell segments 26 together adjacent the end sections 32, thereby forming the multi-piece shell 25. When secured together, the first outer edge 46 of the end section 32 of one shell segment 26 abuts the second outer edge 48 of the end section 32 of an adjacent shell segment 26. The outer edge 42 of the first finger 34 of the one shell segment 26 is positioned adjacent the outer edge 44 of the second finger 36 of the adjacent shell segment 26. The first fingers 34 and the second fingers 36 of the multi-piece shell 25 are, preferably, alternatingly positioned around the multi-piece shell 25.

The multi-piece shell 25 has a first end 70 defined by the first ends 28 of the shell segments 26 and a second end 72 defined by the second ends 30 of the shell segments 26. The inner surfaces 54 of the first fingers 34, the inner surfaces 56 of the second fingers 36, and the inner surfaces 62 of the end sections 32 define a central aperture 74 of the multi-piece shell 25. The central aperture 74 is positioned between the first end 70 and the second end 72 of the multi-piece shell 25 and along a longitudinal axis 76 passing through the multi-piece shell 25. The arcuate shaped inside surfaces 62 of the end sections 32 define a cylindrical shaped portion of the central aperture 74 adjacent the first end 70 of the multi-piece shell 25. The inner surfaces 54 of the first fingers 34 and the inner surfaces 56 of the second fingers 36 diverge from the end section 32 to the second end 72 thereby defining a frustum shaped portion of the central aperture 74 adjacent the second end 72 of the multi-piece shell 25. The outer edges 42 of the first fingers 34 and the outer edges 44 of the second fingers 36 of adjacent shell segments 26 of the multi-piece shell 25 define openings 78 that diverge between the end sections 32 and the distal edges 38 of the second fingers 36.

In the multi-piece shell 25, the projection 98 of the one shell segment 26 is received in the slot 100 of the adjacent shell segment 26. The projection 98 and the slot 100 in adjacent shell segments 26 cooperate with the deformable coupling 68 to maintain the first outer edge 46 and the second outer edge 48 of adjacent end sections 32 together.

The bails 102 of the multi-piece shell 25 cooperate to form a stop which prevents a wedge 80 of the expansion anchor 24 that is received in the central aperture 74 of the multi-piece shell 25 from further movement therein. The stop maintains the wedge 80 received in the central aperture 74 of the multi-piece shell 25 during mounting and use of the expansion anchor 24 on the threaded end 16 of the mine roof bolt 10. The wedge 80 will be described in greater detail hereinafter.

Figure 7:
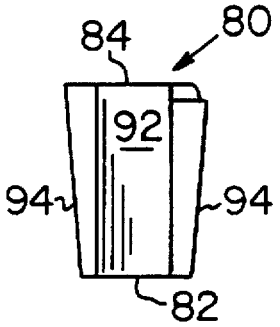
FIG. 7 is a side elevational view of the wedge shown in FIG. 2.
Figure 8:
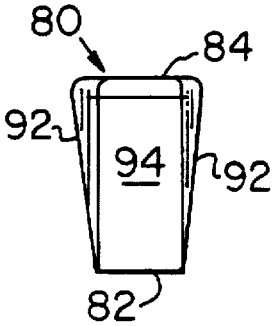
FIG. 8 is a side elevational view of the wedge of FIG. 7 rotated by 90°.
Figure 9:
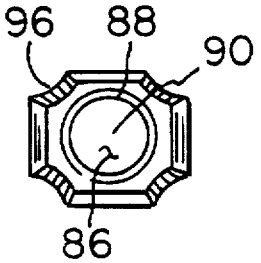
FIG. 9 is a bottom end view of the wedge shown in FIG. 7.

With reference to FIGS. 7–9 and with continuing reference to FIG. 1, the wedge 80 is adapted to be received in the frustum shaped portion of the central aperture 74 adjacent the second end 72 of the multi-piece shell 25. The wedge 80 has a wedge body that defines a cylindrical shaped central bore 86 having threads 88 formed thereon. A longitudinal axis 90 passes through the central bore 86 between a first end 82 and a second end 84 of the wedge 80. The wedge 80 includes first wedging surfaces 92 and second wedging surfaces 94 alternatingly positioned around the wedge body. The first wedging surfaces 92 and the second wedging surfaces 94 are preferably flat and adapted to contact and coact with the inner surfaces 54 of the first fingers 34 and the inner surfaces 56 of the second fingers 36, respectively, of the multi-piece shell 25. The first wedging surfaces 92 and the second wedging surfaces 94 diverge from the first end 82 of the wedge 80 to the second end 84 of the wedge 80. To avoid interference between the wedge 80 and the bore hole wall 4, undercuts 96 are, preferably, formed in the wedge 80. The undercuts 96 are formed between the first end 82 of the wedge 80 and the second end 84 of the wedge 80 and between adjacent wedging surfaces 92, 94.

Figure 10:
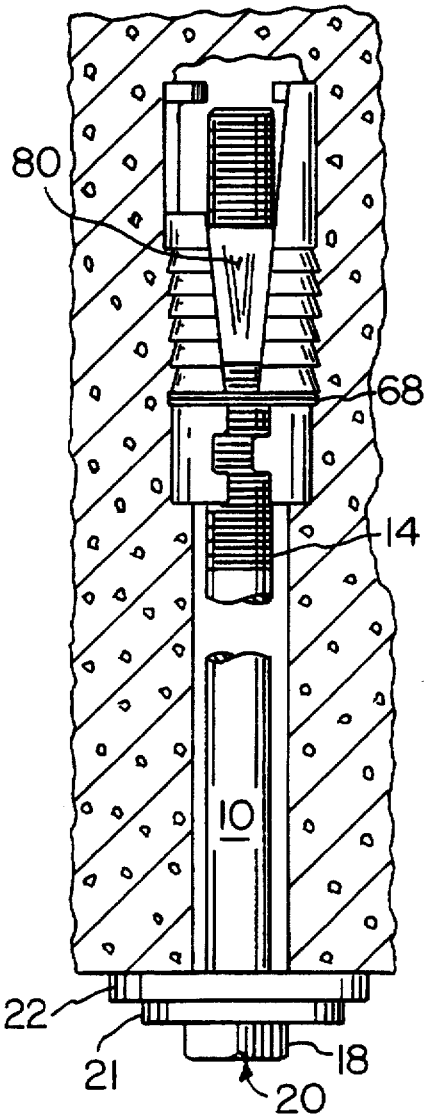
FIG. 10 is an elevational view of the mine roof bolt and expansion anchor of FIG. 1 showing the expansion anchor in an engaged state.

With reference to FIGS. 1 and 10, in use the wedge 80 is received in the central aperture 74 adjacent the second end 72 of the multi-piece shell 25. The divergence of the wedging surfaces 92 and 94 of the wedge 80 is aligned with the frustum shaped portion of the central aperture 74. The first wedging surfaces 92 are in contact or mutual wedging engagement with the inner surfaces 54 of the first fingers 34. The second wedging surfaces 94, adjacent the first end 82 of the wedge 80, are in contact or mutual wedging engagement with the inner surfaces 56 of the second fingers 36 adjacent the distal edges 38 thereof. However, the second wedging surfaces 94 adjacent the second end 84 of the wedge 80 diverge into spaces formed between the distal edges 38 of the second fingers 36 and the second end 72 of the multi-piece shell 25.

The expansion anchor 24, comprised of the multi-piece shell 25 and the wedge 80, is threadedly received on the threaded end of the mine roof bolt 10. Specifically, the threaded end 16 of the mine roof bolt 10 is projected through the cylindrical portion of the central aperture 74 adjacent the first end 70 of the multi-piece shell 25. The threads 88 of the wedge 80 are rotatably engaged by the threads 14 on the threaded end 16 of the mine roof bolt 10. The mine roof bolt 10 and expansion anchor 24 are inserted into the bore hole 2 and positioned so that the threaded end 16 of the mine roof bolt 10 is adjacent the blind end 8 of the bore hole 2 and the headed end 20 of the mine roof bolt 10 extends from the open end 6 of the bore hole 2. The bearing plate 22 is positioned on the bolt shaft 12 between the headed end 20 of the mine roof bolt 10 and the rock surrounding the bore hole 2.

In use, the first fingers 34 and second fingers 36 of the multi-piece shell 25 are expanded by forcibly drawing the wedge 80 from the second end 72 of the multi-piece shell 25 toward the first end 70 of the multi-piece shell 25. This drawing is accomplished by applying a rotating torque to the headed end 20 of the mine roof bolt 10 which causes the bolt shaft 12 to rotate. The rotating threads 14 on the threaded end 16 of the mine roof bolt 10 rotatingly engage the threads 88 in the bore 86 of the wedge 80 thereby forcibly drawing the wedge 80 from the threaded end 16 of the mine roof bolt 10 toward the headed end 20 of the mine roof bolt 10. To avoid having the wedge 80 and the multi-piece shell 25 rotate with the mine roof bolt 10, the multi-piece shell 25 is adapted so that some or all of the outside surfaces 58, 60 or 64 thereof contact the bore hole wall 4 when inserted therein. The interaction of the outside surfaces 58, 60, and/or 64 of the multi-piece shell 25 with the bore hole wall 4 prevents rotation thereof. Moreover, interaction of the wedging surfaces 92 and 94 of the wedge 80 with the inner surfaces 54 and 56 of the first fingers 34 and second fingers 36, respectively, prevents the wedge 80 from rotating inside the central aperture 74 of the multi-piece shell 25. Accordingly, the wedge 80 is permitted to forcibly move along a longitudinal axis passing through the bolt 10 from the second end 72 of the multi-piece shell 25 to the first end 70 thereof in response to the application of the rotating torque.

As shown in FIG. 10, this forcible movement causes the wedging surfaces 92 and 94 of the wedge 80 to wedgingly engage the inner surfaces 54 of the first fingers 34 and the inner surfaces 56 of the second fingers 36, respectively. This wedging engagement forces the fingers 34, 36 to expand in an outward direction when the wedge 80 is moved toward the headed end 20 of the bolt 10. This expansion causes the outer surfaces 58 and 60 of the first fingers 34 and second fingers 36, respectively, and specifically the serrations 66 of the first fingers 34 and the second fingers 36, to forcibly engage the bore hole wall 4. The engagement of the bore hole wall 4 by the fingers resists downward movement of the multi-piece shell 25. By resisting downward movement, the multi-piece shell 25 functions as an anchor against which force can be applied along the longitudinal axis passing through the bolt 10. This force can be used to draw the bearing plate 22 toward the expanded multi-piece shell 25 in response to the application of rotating torque at the headed end 20 of the roof bolt 10. Hence, this arrangement places the mine roof in compression.

As should now be evident, the use of a plurality of identical multi-piece shells to form an expansion anchor having a split anchor results in an inexpensive anchoring device compared to the prior art bail type expansion anchors.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A mine roof bolt expansion anchor comprising:

a plurality of identical shell segments having a first end and a second end, wherein each of the plurality of shell segments includes an end section at the first end of the shell segment, a first finger extending from the end section to the second end of the shell segment and including an outer edge, a second finger extending from the end section toward the second end of the shell segment and terminating at a distal edge spaced from the second end of the shell segment, the second finger having an outer edge that extends between the end section and the distal edge of the second finger, wherein the end section, the first finger and the second finger each include an inner surface and an outer surface, and the outer surfaces of the first finger and the second finger include a plurality of serrations;

a deformable coupling securing the plurality of segments together so that the outer edge of the first finger of one of the shell segments is positioned adjacent the outer edge of the second finger of an adjacent one of the shell segments, the plurality of coupled shell segments forming a multi-piece shell, wherein the inside surfaces of the end sections, the first fingers and the second fingers of the plurality of the shell segments forming the multi-piece shell define a central aperture; and a wedge received in the central aperture and adapted to coact with the plurality of shell segments.

2. The mine roof bolt expansion anchor as set forth in claim 1, wherein the end section of each shell segment has a first outer edge that extends between the first end of the shell segment and the outer edge of the first finger and a second outer edge that extends between the first end of the shell segment and the outer edge of the second finger, wherein the first outer edge lies along a first line that extends parallel to a longitudinal axis passing through each shell segment, the outer edge of the first finger and the first line defining a first angle therebetween, and wherein the second outer edge lies along a second line that extends parallel to the longitudinal axis passing through each shell segment, the outer edge of the second finger and the second line defining a second angle therebetween.

3. The mine roof bolt expansion anchor as set forth in claim 1, wherein the inner surfaces of the first finger and the second finger of each shell segment transition from arcuate shape adjacent the end section to flat adjacent the distal edge of the second finger.

4. The mine roof bolt expansion anchor as set forth in claim 1, wherein each shell segment further includes:

a projection extending from one of the first outer edge and the second outer edge of the end section; and a slot formed in the other of the first outer edge and the second outer edge of the end section into which a projection from an adjacent shell segment is received.

5. The mine roof bolt expansion anchor as set forth in claim 4, wherein the projection of the one of the shell segments is receivable in the slot of the adjacent one of the shell segments when the first outer edge of the end section of the one of the shell segments abuts the second outer edge of the end section of the adjacent one of the shell segments.

6. The mine roof bolt expansion anchor as set forth in claim 1, wherein an opening is defined between the outer edge of the first finger of the one of the shell segments positioned adjacent the outer edge of the second finger of the adjacent one of the shell segments, wherein the opening diverges from the end sections to the distal edge of the second finger of the adjacent one of the shell segments.

7. The mine roof bolt expansion anchor as set forth in claim 1, wherein the wedge has wedging surfaces that contact the inner surfaces of the first fingers and the second fingers of the multi-piece shell whereby the wedge expands the first fingers and the second fingers when the wedge is moved towards the end sections of the multi-piece shell.

8. The mine roof bolt expansion anchor as set forth in claim 1, wherein each shell segment further includes a radially and inwardly extending bail positioned adjacent the second end of the first finger and wherein the bails of the multi-piece shell form a stop for preventing the wedge from further movement in the central aperture.

9. The mine roof bolt expansion anchor as set forth in claim 1, wherein the inner surfaces of the first fingers and the second fingers of the multi-piece shell diverge from the end sections of the multi-piece shell.

10. The mine roof bolt expansion anchor as set forth in claim 9, wherein the central aperture of the multi-piece shell is frustum shaped between the end sections and the second ends of the multi-piece shell.

11. A mine roof bolt expansion anchor comprising:

an expansion shell having a first end and a second end, an end section positioned at the first end of the expansion shell, a plurality of first fingers extending between the end section and the second end of the expansion shell, a plurality of second fingers extending from the end section toward the second end of the expansion shell and terminating in distal edges spaced from the second end of the expansion shell, wherein the end section, the first fingers and the second fingers have inner surfaces defining a central aperture positioned between the first end and the second end that extend along a longitudinal axis and outer surfaces, wherein the expansion shell further includes a plurality of serrations formed on the outer surfaces of the first fingers and the second fingers, wherein the first fingers and the second fingers define openings therebetween; and a wedge positioned within the central aperture.

12. An expansion anchor as set forth in claim 11, wherein the second plurality of fingers and the first plurality of fingers are alternatingly positioned around the expansion shell.

13. The expansion anchor as set forth in claim 12, wherein at least every other opening between the first fingers and the second fingers diverges from the end section to the distal edges of the second pair of fingers.

14. The expansion anchor as set forth in claim 11, wherein each finger of the first plurality of fingers and each finger of the second plurality of fingers have inner surfaces that diverge between the end section and the second end of the expansion shell.

15. The expansion anchor as set forth in claim 14, wherein the wedge includes outer surfaces that extend and diverge from a first end of the wedge to a second end of the wedge.

16. The expansion anchor as set forth in claim 11, wherein the expansion shell is comprised of a plurality of longitudinally extending identical shell segments.

17. The expansion anchor as set forth in claim 11, wherein each of the plurality of first fingers has a radially and inwardly extending bail positioned adjacent the second end of the expansion shell.

18. A mine roof anchoring device usable in a bore hole formed in a rock formation, wherein the bore hole is defined by a bore hole wall and has an open end and a blind end at opposite ends thereof, the mine roof anchoring device comprising:

a bolt having a shaft extending along a longitudinal axis, said bolt having threads defined at a threaded end and a head defined at a headed end and positioned opposite the threaded end;

an expansion shell positioned on the threaded end, wherein the expansion shell includes an end section positioned adjacent a first end of the expansion shell, a plurality of first fingers longitudinally extending from the end section and terminating at a second end of the expansion shell, a plurality of second fingers extending from the end section toward the second end of the expansion shell and terminating in distal edges spaced from the second end of the expansion shell, and a plurality of serrations formed on outside surfaces of the first fingers and the second fingers, wherein the end section, the first fingers and the second fingers define a central aperture extending from the first end of the expansion shell to the second end of the expansion shell and along the longitudinal axis; and a wedge having a wedge body defining a threaded central aperture threadably received by the threaded end of the bolt and positioned within the central aperture of the expansion shell, the wedge body having a plurality of wedging surfaces contacting the first fingers and the second fingers whereby the first fingers and the second fingers prevent the wedge from rotating about the longitudinal axis when the expansion shell is prevented from rotating about the longitudinal axis but permit the wedge to move along the longitudinal axis toward the headed end thereby forcing the first fingers and the second fingers to move in an outwardly direction.

19. The mine roof bolt as set forth in claim 18, wherein the expansion shell is separable into a plurality of longitudinally extending identical shell segments, wherein each segment includes a finger from the first plurality of fingers and a finger from the second plurality of fingers.

20. A shell segment for forming a mine roof expansion anchor which is formed by a plurality of said segments secured to each other by a coupling and a wedge for coacting with said segments, said shell segment comprising:

a first end, a second end, an end section at the first end of the shell segment, a first finger extending from the end section to the second end of the shell segment and including an outer edge, a second finger extending from the end section toward the second end of the shell segment and terminating at a distal edge spaced from the second end of the shell segment, the second finger having an outer edge that extends between the end section and the distal edge of the second finger, wherein the end section, the first finger and the second finger each include an inner surface and an outer surface, and the outer surfaces of the first finger and the second finger include a plurality of serrations.

* * * * *